US005156119A

United States Patent [19]

Suga

[11] Patent Number: 5,156,119

[45] Date of Patent: Oct. 20, 1992

[54] VALVE TIMING CONTROL APPARATUS

[75] Inventor: Seiji Suga, Kanagawa, Japan

[73] Assignee: Atsugi Unisia Corp., Japan

[21] Appl. No.: 734,137

[22] Filed: Jul. 22, 1991

[30] Foreign Application Priority Data

Jul. 31, 1990 [JP] Japan ..... 2-203358

[51] Int. Cl.[5] ..... F01L 1/34

[52] U.S. Cl. ..... 123/90.17; 123/90.31; 464/2

[58] Field of Search ..... 123/90.15, 90.17, 90.31; 464/2

[56] References Cited

U.S. PATENT DOCUMENTS

| | | | |
|---|---|---|---|
| 4,231,330 | 11/1980 | Garcea | 123/90.15 |
| 4,754,727 | 7/1988 | Hampton | 123/90.31 |
| 4.841,924 | 6/1989 | Hampton et al. | 123/90.17 |
| 5,031,585 | 7/1991 | Muir et al. | 123/90.31 |
| 5,056,479 | 10/1991 | Suga | 123/90.17 |

*Primary Examiner*—E. Rollins Cross
*Assistant Examiner*—Weilun Lo
*Attorney, Agent, or Firm*—Ronald P. Kananen

[57] ABSTRACT

A valve timing control apparatus for use in an internal combustion engine having a crankshaft driven by the engine and a camshaft adapted to drive at least one valve. The valve timing control apparatus comprises a rotary member drivingly connected to the crankshaft for rotation with rotation of the crankshaft, and a coupling mechanism for coupling the rotary member to the camshaft to transmit rotation of the rotary member to the camshaft. The rotary member has at least one rotary disc rotatably supported thereon, the rotary disc having a peripheral surface. A pair of friction members is provided on the opposite sides of the rotary member. The friction members are moved in a first direction bringing one of the friction members into frictional engagement with the peripheral surface of the rotary disc so as to rotate the rotary disc in a forward direction and in a second direction bringing the other friction member into frictional engagement with the peripheral surface of the rotary disc so as to rotate the rotary disc in a reversed direction. Rotation of the rotary disc is transmitted through the coupling mechanism to move the camshaft at a desired position with respect to the rotary member.

3 Claims, 3 Drawing Sheets

VALVE TIMING CONTROL APPARATUS

BACKGROUND OF THE INVENTION

This invention relates to a valve timing control apparatus for use in an internal combustion engine to provide desired valve timing(s) according to engine operating conditions.

For example, U.S. Pat. No. 4,231,330 discloses a valve timing control apparatus for controlling the intake or exhaust valve timing according to engine operating conditions. The valve timing control apparatus employs a cylindrical gear having internal and external threaded portions, one of which is in the form of a helical gear. The external threaded portion engages with the inner threaded portion of a rotary drum which is formed on its outer peripheral surface with sprocket teeth for engagement with a timing chain engaging with a sprocket mounted on the crankshaft of the engine. The internal threaded portion of the cylindrical gear engages with the external threaded portion formed on the camshaft of the engine. The camshaft is rotated at an angle with respect to the rotary drum by applying fluid pressures to move the cylindrical gear in an axial direction of the camshaft.

However, the conventional valve timing control apparatus employs an expensive helical gear. The helical gear is required to be machined with high accuracy sufficient to provide smooth valve timing control. Additionally, the conventional valve timing control apparatus is arranged to rotate the camshaft at a great angle with respect to the sprocket by moving the cylindrical gear, which extends axially of the camshaft, to a great distance. This arrangement requires a large space for the valve timing control unit, resulting in a large-sized engine. Still further, the conventional valve timing control apparatus utilizes oil pressure to control the position of the cylindrical gear. However, it is very difficult to maintain the oil pressure at a constant since the oil viscosity varies with changes in oil temperature and engine speed.

SUMMARY OF THE INVENTION

Therefore, a main object of the invention is to provide an inexpensive and compact valve timing control apparatus which can ensure an accurate valve timing control.

There is provided, in accordance with the invention, a valve timing control apparatus for use in an internal combustion engine having a crankshaft driven by the engine and a camshaft adapted to drive at least one valve. The valve timing control apparatus comprises a rotary member drivingly connected to the crankshaft for rotation with rotation of the crankshaft, and a coupling mechanism for coupling the rotary member to the camshaft to transmit rotation of the rotary member to the camshaft. The rotary member has at least one rotary disc rotatably supported thereon, the rotary disc having a peripheral surface. A pair of friction members are provided on the opposite sides of the rotary member. The valve timing control apparatus also comprises control means for moving the friction members in a first direction bringing one of the friction members into frictional engagement with the peripheral surface of the rotary disc so as to rotate the rotary disc in a forward direction and in a second direction bringing the other friction member into frictional engagement with the peripheral surface of the rotary disc so as to rotate the rotary disc in a reversed direction, and means for transmitting rotation of the rotary disc through the coupling mechanism to the camshaft.

BRIEF DESCRIPTION OF THE DRAWINGS

This invention will be described in greater detail by reference to the following description taken in connection with the accompanying drawings, in which.

DETAILED DESCRIPTION OF THE INVENTION

Figure 1:
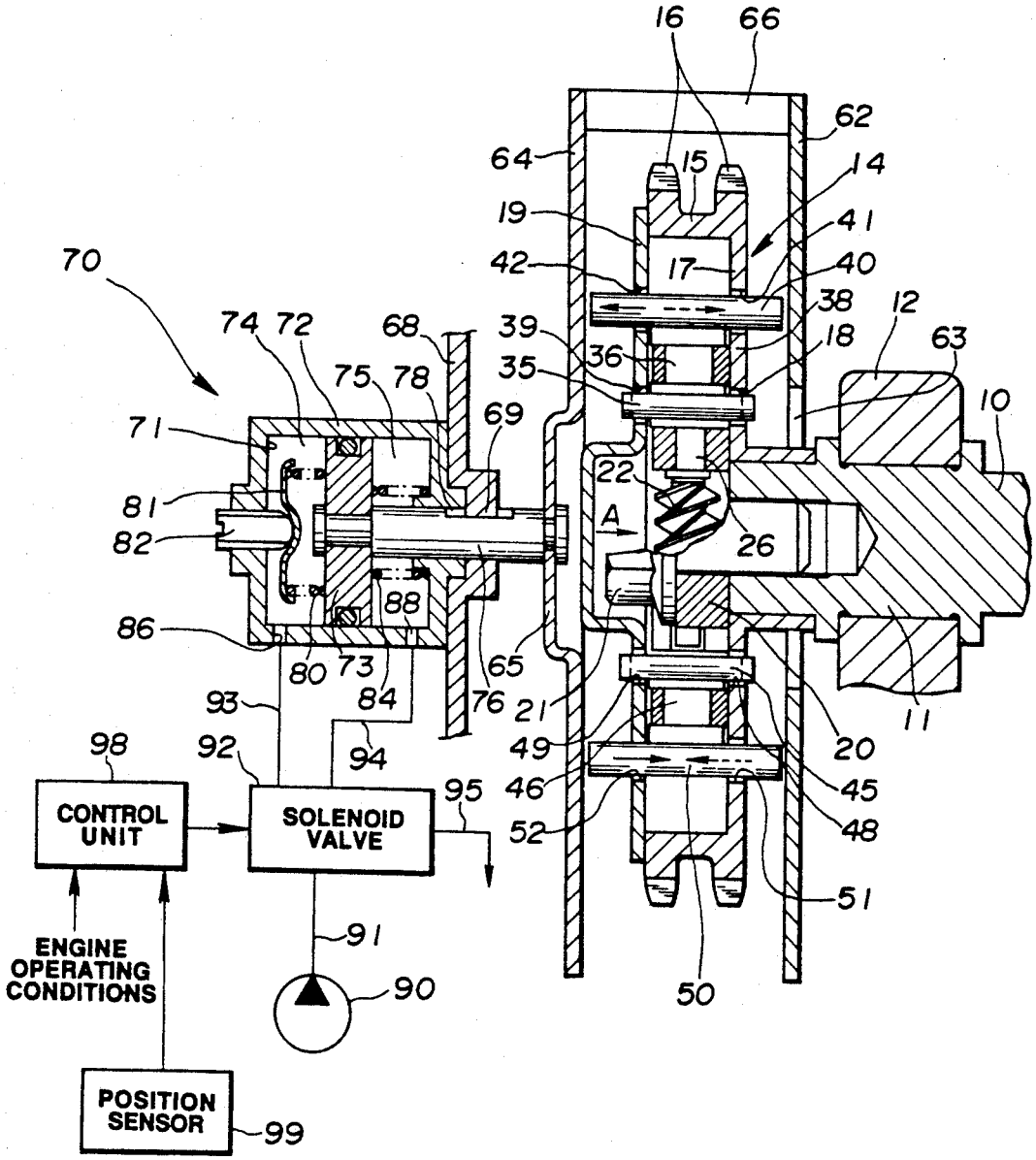
FIG. 1 is a fragmentary longitudinal sectional view showing one embodiment of a valve timing control apparatus made in accordance with the invention.
Figure 2:
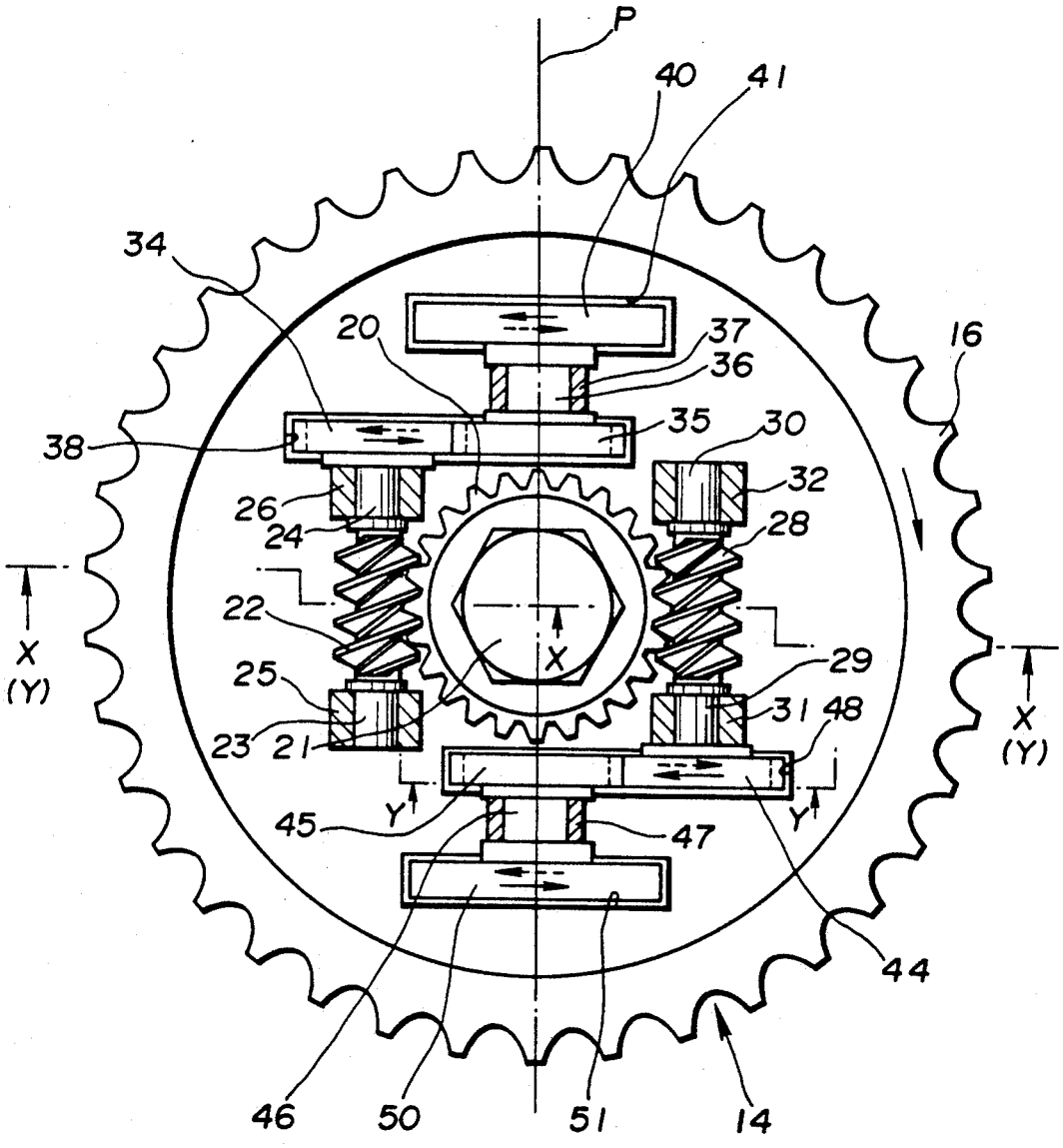
FIG. 2 is a transverse sectional view of the valve timing control apparatus as viewed in a direction indicated by the character A in FIG. 1.

With reference to the drawings and in particular to FIGS. 1 and 2, there is shown a valve timing control apparatus embodying the invention. In the illustrated case, the valve timing control apparatus is applied to a DOHC type internal combustion engine including a camshaft 10. The cam shaft 10 is supported by a bearing 12 for rotation to drive unshown cams so as to open and close the respective intake valves of the engine. The bearing 12 forms a part of the cylinder head of the engine.

The valve timing control apparatus includes a rotary drum 14 comprised of a cylindrical peripheral wall 15 and a circular front end wall 17 integral with the cylindrical peripheral wall 15. The rotary drum 14 has a rear end opening closed by a circular rear end cover 19. The peripheral wall 15 is formed on its outer peripheral surface with sprocket teeth 16 arranged in a pair of parallel lines for engagement with a timing chain (not shown). The timing chain engages with a drive sprocket mounted on the crankshaft (not shown) for transmitting rotation of the crankshaft to rotate the rotary drum 14 at half the speed of the crankshaft. The front end wall 17 is formed with a central boss 18 having a central aperture in which the one end 11 of the camshaft 10 is placed for sliding rotation.

The rotary drum 14 contains a spur gear wheel 20 secured to the end of the camshaft 10 by means of a bolt 21 extending in alignment with the axis of the camshaft 10. The rotary drum 14 also contains a pair of worm gears 22 and 28 positioned in spaced-parallel relation to each other on the opposite sides of the spur gear wheel 20 and held in mesh engagement with the spur gear wheel 20. The first worm gear 22 is rotatably supported at its opposite ends 23 and 24 by respective bearings 25 and 26 fixed on the inner surface of the front end wall 17. Similarly, the second worm gear 28 is rotatably supported at its opposite ends 29 and 30 by respective bearings 31 and 32 fixed on the inner surface of the front end wall 17. The worm gears 22 and 28 revolve with rotation of the rotary drum 14 to rotate the spur gear wheel 20 and thus the cam shaft 10.

Figure 3:
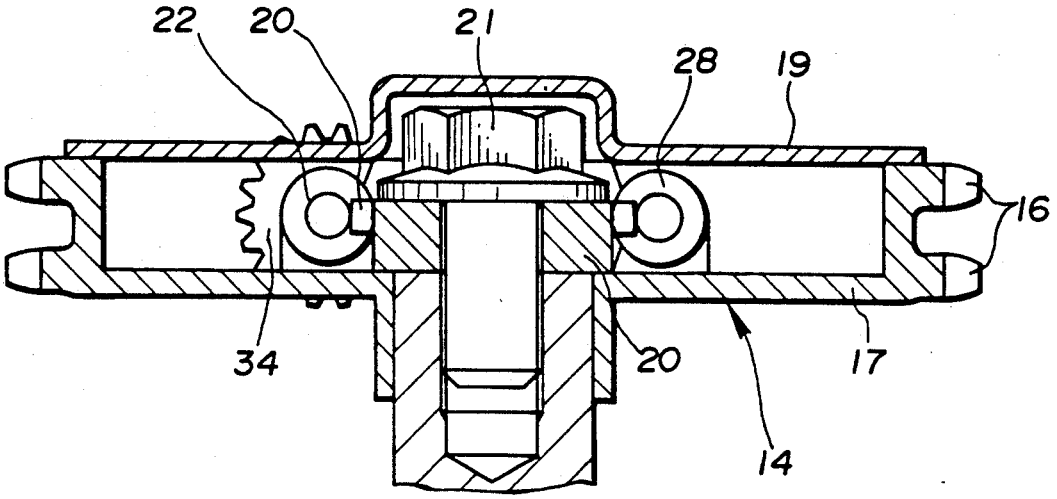
FIG. 3 is a sectional view taken along the lines X—X of FIG. 2.
Figure 4:
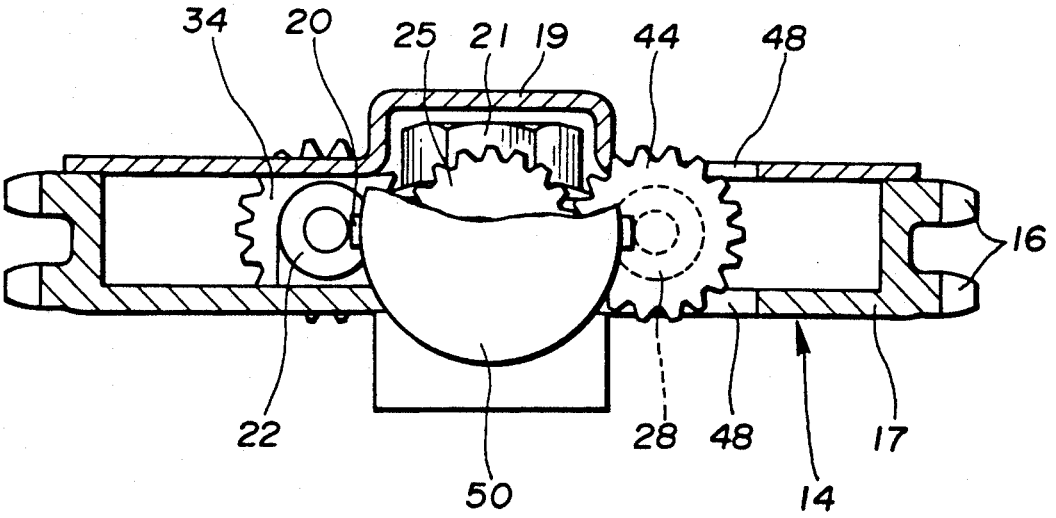
FIG. 4 is a sectional view taken along the lines Y—Y of FIG. 2.

The first worm gear 22 has a spur gear wheel 34 secured at the one end 24 thereof for rotation in unison therewith. The spur gear wheel 34 is held in mesh engagement with another spur gear 35 having a shaft 36 rotatably supported by a bearing 37 fixed on the inner surface of the front end wall 17. The spur gear wheels 34 and 35 extend outward through a window 38 formed in the front end wall 17 and another window 39 formed in the rear end cover 19, as best shown in FIGS. 3 and 4. The windows 38 and 39 ensure free rotation of the spur gear wheels 34 and 35. The shaft 36 has a rotary disc 40 secured thereto for rotation in unison therewith. The rotary disc 40 extends through a window 41 formed in the front end wall 17 and another window 42 formed in the rear end cover 19. The windows 41 and 42 ensure free rotation of the rotary disc 40.

Similarly, the second worm gear 28 has a spur gear wheel 44 secured at the one end 29 thereof for rotation in unison therewith. The spur gear wheel 44 is parallel and diagonally symmetric with the spur gear wheel 34. The spur gear wheel 44 is held in mesh engagement with another spur gear wheel 45 having a shaft 46 rotatably supported by a bearing 47 fixed on the inner surface of the front end wall 17. The spur gear wheel 45 is parallel with and aligned with the spur gear wheel 35. The spur gear wheels 44 and 45 extend outward through a window 48 formed in the front end wall 17 and through another window 49 formed in the rear end cover 19, as best shown in FIGS. 3 and 4. The windows 48 and 49 ensure free rotation of the spur gear wheels 44 and 45. The shaft 46 has a rotary disc 50 secured thereto for rotation in unison therewith. The rotary disc 50 has the same size as the rotary disc 40. The rotary disc 50 is parallel with and aligned with the rotary disc 40. The rotary disc 50 is normal to a line P extending through the center of the rotary drum 14. The rotary disc 50 extends through a window 51 formed in the front end wall 17 and another window 52 formed in the rear end cover 19. The windows 51 and 52 ensure free rotation of the rotary disc 50.

The valve timing control apparatus also includes a pair of friction discs 62 and 64 positioned on the opposite sides of the rotary drum 14. The friction discs 62 and 64 are covered with a material such as rubber or the like having a high coefficient of friction. A connection member 66 connects the friction discs 62 and 64 in a spaced-parallel relation to each other. The distance between the friction discs 62 and 64 is somewhat longer than the diameter of the rotary discs 40 and 50. The first friction disc 62 has a center aperture 63 through which the boss 18 of the front end wall 17 of the rotary drum 14 extends. The center aperture 63 has a diameter much greater than the diameter of the boss 18 to provide free rotation of the rotary drum 14. The second friction disc 64 has a center projection 65.

The numeral 70 designates an actuator for advancing the friction discs 62 and 64 to the right, as viewed in FIG. 1, and retracting them to the left, as viewed in FIG. 1. The actuator 70 includes a cylinder 71 defined in a cylindrical housing 72 which has its front end secured to the rocker cover 68 having a projection 69. A piston 73 is mounted for reciprocal sliding motion within the cylinder 71. The piston 73 divides the cylinder 71 into first and second chambers 74 and 75. Centrally connected to the piston 73 and the center projection 65 is an operation rod 76 extending through a through-hole formed in the rocker cover 68. The operation rod 76 is formed with a slot 78 with which the projection 69 engages to prevent rotation of the operation rod 76 and thus the friction discs 62 and 64. The operation rod 76 is used to produce reciprocal motion of the friction discs 62 and 64 in response to reciprocation of the piston 73 within the cylinder 71. Compression coil springs 80 and 84 are placed in the first and second chambers 74 and 75, respectively, to hold the piston 73 at its neutral position. The compression coil spring 80 is placed between the piston 73 and a spring seat 81. An adjust screw 82 is provided to vary the position of the spring seat 81 so as to adjust the resilient force of the compression coil spring 80.

The numeral 90 designates an oil pump which may be operated by the engine. The output of the oil pump 90 is discharged through a conduit 91 and into the inlet of a solenoid change-over valve 92 having two outlet ports and a drain port. The first outlet port is connected to a conduit 93 which is, in turn, connected through a first port 86 to the first chamber 74. The second outlet port is connected to a conduit 94 which is, in turn, connected through a second port 88 to the second chamber 75. The drain port is connected to a drain conduit 95. The solenoid change-over valve 92 changes between two positions. At the first position, the solenoid valve 92 connects the first chamber 74 to the oil pump 90 and the second chamber 75 to the drain conduit 95. At the second position, the solenoid valve 92 connects the first chamber 74 to the drain conduit 95 and the second chamber 74 to the oil pump 90. The solenoid change-over valve 92 is connected to a control unit 98 which receives sensor signals indicating engine operating conditions including engine load, engine speed, a crankshaft position sensor, and so forth and a sensor signal from a position sensor 99 for controlling the solenoid change-over valve 92. The position sensor 99 is sensitive to an angular position of the camshaft 10 with respect to the rotary drum 14 and it produces a signal indicative of the sensed angular position. The control unit 98 calculates a desired angular position of the camshaft 10 with respect to the rotary drum 14 based upon the engine operating conditions and operates the solenoid valve 92 to rotate the crankshaft 10 to the desired angular position with respect to the rotary drum 14. When the position sensor 99 senses that the camshaft 10 arrives at the desired angular position, the control unit 98 turns off the solenoid valve 91 to hold the camshaft 10 at the desired angular position.

The operation is as follows: When the solenoid valve 92 is off, the piston 73 is held at its neutral position by the aid of the compression coil springs 80 and 84. At the neutral position, the rotary discs 40 and 50 are out of engagement from the friction disc 62 and also from the friction disc 64, as shown in FIG. 1.

At low engine load conditions, the control unit 98 moves the solenoid valve 92 to its first position introducing a pressure from the oil pump 90 into the first chamber 74 while connecting the second chamber 75 to the drain conduit 95. As a result, the piston 73 moves to the right, as viewed in FIG. 1, to bring the friction disc 64 into frictional engagement with the rotary discs 40 and 50. With rotation of the rotary drum 14, the rotary disc 40 rotates in a direction, indicated by the broken arrow in FIG. 1, due to friction between the friction and rotary discs 64 and 40 and the rotary disc 50 rotates in a direction, indicated by the broken arrow in FIG. 1, opposite to the direction of rotation of the rotary disc 40 due to friction between the friction and rotary discs 64 and 50. The rotation of the rotary disc 40 is transmitted through the spur gear wheels 34 and 35 to the worm gear 22, whereas the rotation of the rotary disc 50 is transmitted through the spur gear wheels 44 and 45 to the worm gear 28. As a result, the worm gears 22 and 28 rotate in opposite directions rotating the spur gear wheel 20 in the counter-clockwise directions, as viewed in FIG. 2, to rotate the camshaft 10 with respect to the rotary drum 14 in a direction retarding the intake valve timing. When the camshaft 10 reaches a desired angular position, the control unit 98 turns off the solenoid valve 92 to return the piston 73 to its neutral position so as to retain the camshaft 10 at the desired angular position with respect to the rotary drum 14. A stopper is provided to limit further rotation of the camshaft 10 over a predetermined most retarded timing position.

At high engine load conditions, the control unit 98 moves the solenoid valve 92 to its second position introducing a pressure from the oil pump 90 into the second chamber 75 while connecting the first chamber 74 to the drain conduit 95. As a result, the piston 73 moves to the left, as viewed in FIG. 1, to bring the friction disc 62 into frictional engagement with the rotary discs 40 and 50. With rotation of the rotary drum 14, the rotary disc 40 rotates in a direction, indicated by the solid arrow in FIG. 1, due to friction between the friction and rotary discs 62 and 40 and the rotary disc 50 rotates in a direction, indicated by the solid arrow in FIG. 1, opposite to the direction of rotation of the rotary disc 40 due to friction between the friction and rotary discs 62 and 50. The rotation of the rotary disc 40 is transmitted through the spur gear wheels 34 and 35 to the worm gear 22, whereas the rotation of the rotary disc 50 is transmitted through the spur gear wheels 44 and 45 to the worm gear 28. As a result, the worm gears 22 and 28 rotate in opposite directions rotating the spur gear wheel 20 in the clockwise direction, as viewed in FIG. 2, to rotate the camshaft 10 with respect to the rotary drum 14 in a direction advancing the intake valve timing. When the camshaft 10 reaches a desired angular position, the control unit 98 turns off the solenoid valve 92 to return the piston 73 to its neutral position so as to retain the camshaft 10 at the desired angular position with respect to the rotary drum 14. A stopper is provided to limit further rotation of the camshaft 10 over a predetermined most advanced timing position.

Although the invention has been described in connection with intake valve timing control, it is to be understood that the invention is equally applicable to control the exhaust valve timing. Although the invention has been described in conjunction with a specific embodiment thereof, it is evident that many alternatives, modifications and variations will be apparent to those skilled in the art. For example, the gear trains each including a worm gear and spur gear wheels for transmitting rotation of the corresponding one of the rotary disc 40 and 50 to the spur gear wheel 20 may be replaced with a single gear. Accordingly, it is intended to embrace all alternatives, modifications and variations that fall within the broad scope of the appended claims.

What is claimed is:

1. A valve timing control apparatus for use in an internal combustion engine having a crankshaft driven by the engine and a camshaft adapted to drive at least one valve, comprising:

a rotary member drivingly connected to the crankshaft for rotation with rotation of the crankshaft, the rotary member having at least one rotary disc rotatably supported thereon, the rotary disc having a peripheral surface;

a coupling mechanism for coupling the rotary member to the camshaft to transmit rotation of the rotary member to the camshaft;

a pair of friction members provided on the opposite sides of the rotary member;

control means for moving the friction members in a first direction bringing one of the friction members into frictional engagement with the peripheral surface of the rotary disc so as to rotate the rotary disc in a forward direction and in a second direction bringing the other friction member into frictional engagement with the peripheral surface of the rotary disc so as to rotate the rotary disc in a reversed direction; and means for transmitting rotation of the rotary disc through the coupling mechanism to the camshaft.

2. The valve timing control apparatus as claimed in claim 1, wherein the control means includes means responsive to engine operting conditions for calculating a desired angular position of the camshaft with respect to the rotary member, means for detecting an angular position of the camshaft with respect to the rotary member, and means for moving the friction members out of frictional engagement from the peripheral surface of the rotary disc when the camshaft reaches the desired angular position with respect to the rotary member.

3. The valve timing control apparatus as claimed in claim 1, wherein the rotary disc extends transversely through the rotary member.

* * * * *